US005977502A

United States Patent [19]

Mizoguchi et al.

[11] Patent Number: 5,977,502

[45] Date of Patent: Nov. 2, 1999

[54] GAS CIRCUIT BREAKER

[75] Inventors: Hitoshi Mizoguchi; Tadashi Mori, both of Yokohama; Hiromichi Kawano, Kawasaki; Katsumi Suzuki; Mitsuru Toyoda, both of Yokohama, all of Japan

[73] Assignee: Kabushiki Kaisha Toshiba, Kawasaki, Japan

[21] Appl. No.: 09/237,920

[22] Filed: Jan. 27, 1999

[30] Foreign Application Priority Data

Jan. 29, 1998 [JP] Japan ..... 10-017001

[51] Int. Cl.[6] ..... H01H 33/18; H01H 33/70; H01H 33/82

[52] U.S. Cl. ..... 218/43; 218/48; 218/60; 218/65

[58] Field of Search ..... 218/43, 46, 47, 218/48–9, 50, 65, 60, 61, 62, 63, 64, 118, 119, 123, 124, 125

[56] References Cited

U.S. PATENT DOCUMENTS

| | | | |
|---|---|---|---|
| 4,992,634 | 2/1991 | Thuries et al. | 218/43 |
| 4,996,398 | 2/1991 | Dufournet et al. | 218/119 |
| 5,898,150 | 4/1999 | Gallix et al. | 218/66 |

FOREIGN PATENT DOCUMENTS 57-54886 11/1982 Japan .

7-109744 11/1995 Japan .

*Primary Examiner*—Lincoln Donovan

*Attorney, Agent, or Firm*—Oblon, Spivak, McClelland, Maier & Neustadt, P.C.

[57] ABSTRACT

The gas circuit breaker has a configuration such that a stationary contact section and a movable contact section are arranged in an arc-extinguishing gas sealed container, to face each other, and the movable contact section includes a hollow operating rod having an exhaust hole at its rear portion, a movable cylinder arranged around the rod, a hollow movable arc contact provided on the movable cylinder and an insulating nozzle surrounding the movable arc contact. The movable contact section further includes a stationary piston portion insertable/removable inside the movable cylinder, and the space formed by the movable cylinder and the current collecting cylinder fixed to the stationary piston portion is partitioned by a parting plate into a thermal pressure elevation room space at front side and a compression room space at rear side. During the electrode opening operation, the compression room space is compressed by the interaction between the movable cylinder and the piston portion, thus increasing the pressure in the space, and the speed of the movement of the operating rod is slowed down just before the completion of the electrode opening operation.

18 Claims, 6 Drawing Sheets

GAS CIRCUIT BREAKER

BACKGROUND OF THE INVENTION

The present invention relates to a gas circuit breaker for interrupting a current which occurs due to a ground fault of a line or a short-circuiting failure between lines, for the purpose of protecting an electricity transmission system or an electricity distribution system, and more specifically to a gas circuit breaker capable of extinguishing an arc by utilizing both of a mechanical compression and a pressure elevation effect caused by the thermal energy of the arc, thereby interrupting a current.

At present, as a breaker for protecting a high voltage transmission system of 72 kV or higher, the puffer type gas circuit breaker made of a simple structure, and having a high reliability and an excellent gas-breaking performance, is widely used. The puffer type gas circuit breaker operates in the following manner. That is, an arc-extinguishing gas such as $SF_6$ gas is compressed by the movable cylinder which is directly connected to the movable contact, so as to generate a high-pressure gas flow, and the gas flow is blown on the arc, so as to extinguish the arc, thereby interrupting the current. Therefore, the interruption performance is determined by the pressure elevation within the movable cylinder. Therefore, when a high pressure elevation is obtained, a high interruption performance is obtained; however the pressure elevation causes a reaction force of the mechanical driving force. Consequently, high driving energy is required to achieve a high interruption performance.

Under these circumstances, there have been a variety of developments and researches made for producing gas circuit breakers of a high interruption performance, which can obtain a high pressure elevation with small driving energy. An example of such breakers is disclosed in Jpn. Pat. Appln. KOKOKU Publication No. 57-54886 and U.S. Pat. No. 4,139,752. In these documents, the development on the basis of the following method is discussed. That is, a thermal pressure elevation room, the pressure inside of which is elevated as a high-temperature gas flows into the room from an arc, is provided in front of the compression room, and a check valve for inhibiting the gas from flow into the compression room from the thermal pressure elevation room is mounted to the partition wall between the thermal pressure elevation room and the compression room, so as to have both rooms communicated one another. Thus, the flow of the high-temperature gas from the thermal pressure elevation room to the compression room, which occurs when a large current is interrupted, is prevented, so as to maintain the pressure elevation in the compression room at a low rate, thereby decreasing the driving energy.

Further, as an improved version of the above-described technique, which can reduce the driving energy more effectively, a gas circuit breaker as shown in FIG. 1 has been developed. (See Jpn. Pat. Appln. KOKAI Publication No. 7-109744)

The conventional gas circuit breaker will now be described with reference to FIG. 1. FIG. 1 is a cross section of the conventional breaker, the lower half of which indicated by the center line in the figure, illustrates an electrode closing state, and the upper half of which illustrates the state of the completion of the closing operation.

As can be seen in FIG. 1, a stationary contact section 10 and a movable contact section 20 are arranged such as to face each other within a container (not shown) filled with an arc-extinguishing gas. It should be noted that with regard to the position of the movable contact section 20, the stationary contact section 10 side is defined as the forward side, and the opposite side is defined as the backward side, for the sake of the convenience of explanation.

The stationary contact section 10 is made of a stationary arc contact 1 and a stationary conductive contact 2 arranged around the arc contact 1. The movable contact section 20 is made of a hollow operating rod 3 having a flange 3*a* at its front end portion, a movable cylinder 4 arranged around the operating rod 3 and connected to the flange 3*a*, a hollow movable arc contact 5 fixed to the movable cylinder 4, and having a plurality of fingers arranged in line along the lateral face of the imaginary cylinder such as to be apart from each other, a movable conductive contact 6 disposed around the arc contact 5, an insulating nozzle 7 surrounding the movable arc contact 5 and a stationary piston member 8 inserted to the rear portion of the movable cylinder 4.

The interior of the movable cylinder 4 is partitioned by a middle partitioned plate 4*a* into a thermal pressure elevation room $S_1$ located at the front, and a compression room $S_2$ at the back. A check valve 16 is provided on the middle partition plate 4*a*, so as to inhibit the gas flow from the thermal pressure elevation room $S_1$ to the compression room $S_2$, and allow the counter gas flow. Between the movable arc contact 5 and the nozzle 7, a gas flow path is provided to guide the gas from the thermal pressure elevation room $S_1$ to the stationary arc contact 1 side.

In the movable contact section 20, the operating rod 3 is formed to reciprocate in its axial direction as driven by a drive device (not shown), and at the rear position of the operating rod 3, a plurality of exhaustion holes 3*b* which can make the hollow portion of the rod and the gas-filled atmosphere communicate, are made.

A piston 8*a* is formed to have a donut-disk shape, the inner circumferential surface of which slides on the outer circumferential surface of the operating rod 3 and the outer circumferential surface of which slides on the inner circumferential surface of the portion of the movable cylinder 4 which forms a compression room space $S_2$. Here, the piston 8*a* has a hollow supporting tube 8*b* provided integrally at the rear portion thereof so as to extend in the axial direction, and the piston 8*a* is fixed by the supporting tube 8*b* within a container (not shown) via a supporting insulating member (not shown).

As the operating rod 3 and the movable cylinder 4 moves as an integral unit with relative to the piston 8*a* fixed as above, the movable cylinder 4 and the piston 8*a* move relative to each other, and thus the compression room space $S_2$ created within the movable cylinder 4 is compressed. At the rear portion of the supporting tube 8*b*, a plurality of exhaust holes 8*c* which make the hollow portion of the supporting tube and the gas-filled atmosphere within the container communicate to each other, are made.

Further, the piston 8*a* is equipped with a release valve 18 which limits a pressure elevation in the space $S_2$ by releasing gas within the compression room space $S_2$ to the gas-filled atmosphere when the pressure elevation in the compression room space $S_2$ exceeds a predetermined value during the electrode opening operation which interrupts a large current, and a check valve 17 can prevent the pressure reduction in the compression room space $S_2$ by allowing the gas to flow from the gas-filled atmosphere to the compression space $S_2$ during the electrode closing operation.

Further, a plurality of grooves 3*d* and 3*e* are made at two locations on the outer circumferential surface of the operating rode 3 by process, to extend in the axial direction. The groove 3*d* is formed to be situated, for its entire length, within the compression room space $S_2$ when the electrode is closed as shown in the cross section of the lower half of FIG. 1, and to have the compression room space $S_2$ communicate to the gas-filled atmosphere when the electrode is opened as shown in the upper half of FIG. 1.

The groove 3*e* is formed to have the compression room space $S_2$ and the gas-filled atmosphere communicate to each other when the electrode is closed. The function of the groove 3*d* is to assure a decrease of the pressure elevation of the compression room space $S_2$ at the final stage of the electrode opening operation, so as to contribute to the achievement of the lowering the driving energy. The function of the groove 3*e* is to assure the gas flow to the compression room space $S_2$ at the final stage of the electrode closing operation.

Next, the operation of interrupting a current by means of the electrode opening operation of the conventional gas circuit breaker shown in FIG. 1 will now be described.

During the electrode opening operation, the operating rod 3 is moved in the direction indicated by arrow D, and therefore the movable section including the operating rod 3, that is, the operating rod 3, the movable cylinder 4 connected thereto, the movable arc contact 5, the movable conductive contact 6 and the nozzle 7 are moved as an integral unit to the direction indicated by arrow D. Thus, the volume of the compression room space $S_2$ created by the rear portion of the movable cylinder 4, which is defined by the middle partition wall 4*a*, and the piston 8*a*, is reduced, and therefore the pressure within the compression room space $S_2$ is increased. The check valve 16 opens its valve rapidly to follow the accelerated movement of the movable section in the beginning of the electrode opening operation, and thus the open state of the check valve 16 is maintained due to the pressure elevation in the compression room space $S_2$, which occur from then onward. Therefore, the gas flows from the compression room space $S_2$ to the thermal pressure elevation room $S_1$. Consequently, the pressure within the thermal pressure elevation room $S_1$ is slightly increased, and the gas flows in the direction towards the stationary arc contact 1 through a flow path between the nozzle 7 and the movable arc contact 5.

In the meantime, due to the electrode opening operation described above, first, the stationary conductive contact 2 and the movable conductive contact 6 are separated from each other, and then after some delay, the stationary arc contact 1 and the movable arc contact 5 are separated from each other. Thus, an arc is generated between the arc contacts 1 and 5. When the interruption current is as small as about 1 kA or less, the pressure elevation in the thermal pressure elevation space $S_1$ due to the interruption current is so low that the gas flow state from the compression room space $S_2$ to the thermal pressure elevation room $S_1$ is maintained. Consequently, the gas is blown to the arc, thereby causing the interruption.

By contrast, when a large current of about several tens of kilo amperes is interrupted, the high-temperature gas from the arc flows reversely in the flow path between the nozzle 7 and the movable arc contact 5, and enters the thermal pressure elevation room space $S_1$ so as to heat the gas within the thermal pressure elevation room space $S_1$ thus elevating the pressure to a high value. Due to the high pressure, a gas flow is created from the nozzle 7 towards the stationary arc contact 1 to cool down the arc, and the arc is extinguished finally at the zero point of the alternating current wave, where the interruption current becomes zero.

When the pressure of the thermal pressure elevation room space $S_1$ is raised high, the check valve 16 is closed and the gas flow from the thermal pressure elevation room space $S_1$ to the compression room space $S_2$ is inhibited. Therefore, the pressure elevation in the compression room space $S_2$, which is caused by the flow-in of the high temperature gas, is prevented.

However, at the same time, the flow-out of the gas from the compression room space $S_2$ to the thermal pressure elevation space $S_1$ is ceased. Therefore, the pressure elevation in the compression room space $S_2$ becomes significantly high as compared to the pressure elevation which occurs in the electrode opening operation with no load or in the electrode opening operation for interrupting a small current. However, at this time, the release valve 18 operates so as to keep the pressure elevation in the compression room space $S_2$ at a predetermined low value. Further, at the final stage of the electrode opening operation, the compression room space $S_2$ communicates to the gas-filled atmosphere via the groove 3*d* as can be seen in the cross section of the upper half of FIG. 1, thus assuring a decrease in the pressure elevation value in the compression room space $S_2$. In this manner, the interruption of a large current and the lowering of the drive energy are achieved.

However, such a conventional gas circuit breaker as described above, has characteristics as shown in FIG. 2, that is, in order to interrupt a large current caused by a short-circuiting accident, when the current value becomes low as it goes beyond the vicinity of a peak, the pressure elevation value decreases steeply, and the pressure elevation value at the current zero point significantly decreases as compared to that at the peak of the pressure elevation value. The characteristics described here are discussed in thesis CIGRE-13-110-1994-P6-FIG. 11. A significant decrease in the pressure elevation is a phenomenon which occurs inevitably in the thermal pressure elevation room space $S_1$, which has no compression effect, and the phenomenon is caused by the ceasing of the flow of the high-temperature gas from the arc to the thermal pressure elevation room space $S_1$, which occurs when the current value is decreased, or by the rapid reduction of the volume of the high temperature gas located close to the arc.

Apart from the above, it is necessary to obtain a high pressure elevation at the zero current point, for achieving a high interruption performance. Therefore, the reduction of the pressure at the current zero point becomes more significant as the arc time is prolonged. Thus, it is difficult to maintain a high interruption performance. When the peak of the pressure increase value is increased, a high interruption performance can be maintained. However, it is clear that such a method would increase the reaction force to the driving force, and therefore it is not efficient.

Further, the pressure elevation in the thermal pressure elevation room space $S_1$ at the interruption of a large current is achieved not by an increase in the density, caused by the compression and/or the flow of the gas from the compression room chamber $S_2$, but by an increase in the temperature, caused by the high temperature gas from the arc. Consequently, when the gas flows out of the nozzle 7 while the temperature keeps on increasing after the interruption of the current, and the pressure decreases to substantially the same pressure of the gas-filled atmosphere, the gas density of the thermal pressure elevation room space $S_1$ has already decreased significantly to a level lower than the initial value (which is the same as the gas density within the gas-filled atmosphere).

In order to maintain stable power supply after an accident in a power supply system, a gas circuit breaker is required to have a performance of a high speed electrode re-closing interruption, in which the electrode is re-closed immediately after an interruption, and thus another interruption is carried out immediately, as a specification of the device. When the gas density in the thermal pressure elevation room space $S_1$ is significantly low after an interruption, it is very difficult to obtain a sufficiently high pressure elevation value when a re-interruption is carried out immediately after an interruption. Further, even if the pressure is elevated, a low-density gas is blown to the arc, and therefore the interruption performance is deteriorated. The deterioration of the high-speed electrode re-closing interruption performance is a serious problem, and as a solution, it is required to increase the gas compression cross sectional area of the compression room space $S_2$ or to increase the driving energy. In the gas circuit breaker, there is an increased amount of load on the damper of the breaker, and therefore the size of the damper is increased.

In general, gas circuit breakers employ a damper operating on oil pressure or the like, for the purpose of decreasing the speed of the movable section immediately before the completion of the electrode opening operation, so that the section can stop at low impact. Although it has been stated above that an excessive pressure increase in a puffer-type gas circuit breaker which compresses the gas with a movable cylinder, is not desirable since it increases the driving energy, as far as the pressure elevation in the compression room immediately before the completion of the electrode opening operation is concerned, it is desirable for the reducing the speed, and further the load on the damper is lightened. In the case of the gas circuit breaker having the structure as shown in FIG. 1, the pressure elevation in the compression room space $S_2$ is limited by the release valve, and in the final stage, it is further reduced by the groove 3*d*. Then, at the completion of the electrode opening operation, the pressure elevation becomes substantially zero. Therefore, the speed reduction effect for the movable section, caused by the pressure elevation in the compression room space $S_2$, is not expected, and therefore the speed reduction must be taken care of only by the damper equipped. As a result, it is necessary to increase the size of the damper.

As described above, in order to solve the problems of the deterioration of the interruption performance and the enlargement of the equipment device, the size of the entire breaker including the driving mechanism must be increased to improve the performance. However, the enlargement of the size of the breaker will result in economical disadvantages in manufacturing and operation of the gas circuit breaker, and therefore it is not desirable.

BRIEF SUMMARY OF THE INVENTION

The object of the present invention is to provide a small-sized economical gas circuit breaker having a high current interruption performance and operating with low driving energy, in which during the current interrupting operation, a high pressure elevation is obtained in the thermal pressure elevation room space which has an influence on the interruption performance, whereas a pressure elevation in the compression room space is suppressed to a minimum necessary limit, and the movement of the movable section can be effectively slowed down just before the completion of the electrode opening operation.

In order to achieve the above-described object, there is provided, according to the first aspect of the present invention, a gas circuit breaker including:

a container filled with an arc extinguishing gas;

a stationary contact section arranged in the container to be fixed thereto, the stationary contact section having a stationary arc contact; and a movable contact section arranged to face the stationary arc contact, the movable contact section further comprising:

a hollow operating rod having a front end portion facing the stationary arc contact and a rear end portion situated away from the stationary arc contact, the operating rod having an exhaust hole in the rear end portion thereof, and being capable of moving forwards linearly towards the stationary arc contact and backwards linearly in an opposite direction;

a hollow movable cylinder arranged to be coaxial with the operating rod and separated therefrom, so as to surround a part of an outer surface of the operation rod, which is close to the front end portion, and having a flange fixed to an outer circumferential portion of the front end portion of the operating rod, so as to seal a gap between the outer circumferential portion and an outer surface of the movable cylinder;

a hollow movable arc contact mounted on the front end portion of the operating rod so as to face the stationary arc contact and be able to be engaged therewith;

an insulating nozzle mounted on the flange of the movable cylinder so as to surround the movable arc contact with a distance, the insulating nozzle and the movable arc contact forming a first flow path for having an interior of the movable cylinder and an atmosphere in the container filled with the arc extinguishing gas communicate to each other through a first opening made in the flange of the movable cylinder;

a hollow stationary supporting tube arranged to be coaxial with the operating rod, so as to surround a part of the outer surface of the operating rod, other than the front end portion, the stationary supporting tube having a rear end portion fixed to the container, a front end portion substantially facing the flange of the movable cylinder, and including a piston plate having a portion which defines an inner diameter thereof, being made slidable on the outer surface of the operating rod, and a portion which defines an outer diameter thereof, being flush with an outer surface of the stationary supporting tube, and the stationary supporting tube having a second opening in a section close to the rear end portion, communicating to the atmosphere of the container filled with the gas, a space defined by an inner surface of the supporting tube, an outer surface of the operating rod and the piston plate to form a second flow path for the gas, and the stationary supporting tube being formed insertable and removable with respect to the movable cylinder;

a parting plate, provided on a rear end portion of the movable cylinder, and forming a first space surrounded by the outer surface of the operating rod and an inner surface of the movable cylinder, a portion which defines an inner diameter of the parting plate being formed slidable on the outer surface of the stationary supporting tube, and a portion which defines an outer diameter of the parting plate being larger than an outer diameter of the movable cylinder;

a current collecting cylinder disposed to be coaxial with the operating rod, a part of the current collecting cylinder being formed slidable on a portion which defines an outer diameter of the parting plate of the movable cylinder, having a current collecting plate at a front end portion thereof, which slides on the outer surface of the movable cylinder and being electrically contact therewith, and having a supporting plate at a rear end portion thereof fixed to the stationary supporting tube, the current collecting cylinder forming a second space together with the parting plate, the stationary supporting tube and the supporting plate, having a plurality of grooves in an inner surface of a central portion thereof in an axial direction of the operating rod, engraved to be parallel to the axial direction, and a plurality of communication holes piercing from an inner surface to an outer surface at a portion of the current collecting cylinder situated between the plurality of grooves and the current collecting plate; and a check valve provided on the parting plate, for making the first space and the second space communicate to each other.

Further, the gas circuit breaker may have a structure, wherein during a current interruption operation in which the operating rod is drawn backwards from a state of the movable arc contact being engaged with the stationary arc contact, and the movable arc contact separates from the stationary arc contact, the gas in the second space is compressed by the parting plate, and a high-temperature gas made by an arc generated by the current interruption operation flows into the first space via the first flow path, thereby heating the first space to cause a pressure elevation.

Furthermore, the gas circuit breaker may have a structure, wherein during a current interruption operation, when the portion which defines the outer diameter of the parting plate of the movable cylinder moves to a portion facing the plurality of grooves of the current collecting cylinder, the gas compressed in the second space flows out to the atmosphere of the container filled with the arc-extinguishing gas via the plurality of grooves and the plurality of communicating holes, thereby decreasing a pressure in the second space.

Furthermore, the gas circuit breaker may have a structure, wherein during a current interruption operation, when the portion which defines the outer diameter of the parting plate of the movable cylinder moves beyond and passes a portion facing the plurality of grooves of the current collecting cylinder, the gas in the first space which has an elevated pressure flows out to the atmosphere of the container filled with the arc-extinguishing gas via the first flow path, thereby extinguishing an arc.

Furthermore, the gas circuit breaker may have a structure, the operating rod has a third opening communicating to the second flow path situated between the stationary supporting tube and the operating rod, and a high temperature gas made by an arc flows out to the atmosphere of the container filled with the arc-extinguishing gas via a hollow portion of the operating rod, the third opening and the second flow path.

Furthermore, the gas circuit breaker may have a structure, wherein during a current interruption operation, when the portion which defines the outer diameter of the parting plate of the movable cylinder passes a portion facing the plurality of grooves of the current collecting cylinder, and further moves close to the supporting plate, the check valve provided on the parting plate is opened, and thus the gas in the second space in which a pressure is elevated flows out to the first space.

Furthermore, the gas circuit breaker may have a structure, wherein the parting plate and the movable cylinder are formed integrally.

Furthermore, the gas circuit breaker may have a structure, wherein the parting plate is formed as a separate member from the movable cylinder.

Furthermore, the gas circuit breaker may have a structure, wherein the current collecting cylinder comprises an outer cylinder and an inner cylinder, and the plurality of grooves are formed as opening portions which piercing through the inner cylinder.

Furthermore, the gas circuit breaker may have a structure, wherein the operating rod has a fourth opening which communicates to the second flow path between the stationary supporting tube and the operating rod immediately after separating the stationary arc contact and the movable arc contact from each other, and a high-temperature gas created by an arc generated by a separation of the stationary arc contact and the movable arc contact from each other flows out to the atmosphere of the container filled with the arc-extinguishing gas via the hollow portion of the operating rod, the fourth opening and the second flow path.

According to the first aspect of the present invention, in the initial stage of the electrode opening operation, the gas in the first space (thermal pressure elevation room space) formed by the parting plate at the rear end of the movable cylinder, the stationary supporting tube and the piston plate at the front end thereof, and the like is compressed by the stationary piston plate having a small diameter and a small cross sectional area, and thus the pressure is slightly elevated. During this period, the gas in the second space (compression room space) formed by the parting plate at the rear end of the movable cylinder, the current collecting cylinder and the like, is compressed by the surface of the parting plate, which is located on the compression room side. In the initial stage of the electrode opening operation, the pressure elevation of the compression room space is set to be higher than that of the thermal compression room space. At this point, the check valve provided on the parting plate is open due to the accelerated movement of the movable operation, the gas flows from the compression room space to the thermal pressure elevation room, and thus the initial gas density and the pressure in the thermal pressure elevation room space are raised.

As the electrode opening operation proceeds, the stationary arc contact and the movable arc contact are separated from each other, and an arc is generated therebetween due to a high current. Consequently, a high-temperature gas created by the arc starts to flow into the thermal pressure elevation room space, and the temperature of the thermal pressure elevation room space is increased, thus rapidly increasing the pressure. Further, together with the pressure of the compression room space, the pressure of the thermal pressure elevation room space is further elevated. In such a state, the check valve provided on the parting plate at the rear end of the movable cylinder is closed.

In the meantime, in the compression room space, the gas flow to the thermal pressure elevation room space is blocked, and therefore the pressure starts to further increase. However, just about that point, the compression room space communicates to the gas-filled atmosphere via the grooves provided in the inner surface of the middle portion of the current collecting cylinder. Therefore, the pressure of the gas in the compression room rapidly decreases, and thus the pressure elevation can be kept at a low value. Due to this effect, the reaction force against the drive force can be maintained at a low level, and the drive energy can be decreased.

Further, the thermal pressure elevation room space is continuously compressed by the piston plate having a small cross section, and therefore the lowering of the pressure elevation value is suppressed. Thus, the pressure elevation value at the interruption current zero point is maintained at a high value close to the pressure elevation peak value, and a high current interruption performance can be continuously obtained. Further, as the electrode opening operation further proceeds to be close to the completion of the electrode opening operation, the communication between the compression room space and the gas-filled atmosphere is closed due to the grooves set to have such a length, and the pressure in the compression room once again rapidly increases to become higher than that of the thermal pressure elevation space. Consequently, the check valve provided on the parting plate situated at the rear end of the movable cylinder is opened, and thus the gas flows from the compression room space to the thermal pressure elevation room space. Due to this effect, the gas density in the thermal pressure elevation room space, which was decreased after interruption, increases, and therefore the deterioration of the high-speed electrode re-close interruption performance can be prevented.

Further, due to the pressure elevation, the movable section is reduced in speed, and therefore the damper to be equipped to the apparatus can be reduced in size. Furthermore, during the electrode opening operation, the gas which moves from the arc to the hollow portion of the operating rod flows into the thermal pressure elevation room space in the initial stage of the operation, and the temperature of the room space is increased. In this manner, the pressure in the thermal pressure elevation room space can be effectively increased.

According to the second aspect of the present invention, there is provided a gas circuit breaker comprising:

container filled with an arc extinguishing gas;

a stationary contact section arranged in the container to be fixed thereto, the stationary contact section having a stationary arc contact; and a movable contact section arranged to face the stationary arc contact, the movable contact section further comprising:

a hollow operating rod having a front end portion facing the stationary arc contact and a rear end portion situated away from the stationary arc contact, the operating rod having an exhaust hole in the rear end portion thereof, and being capable of moving forwards linearly towards the stationary arc contact and backwards linearly in an opposite direction;

a hollow movable cylinder arranged to be coaxial with the operating rod and separated therefrom, so as to surround a part of an outer surface of the operation rod, which is close to the front end portion, and having a flange fixed to an outer circumferential portion of the front end portion of the operating rod, so as to seal a gap between the outer circumferential portion and the outer surface of the movable cylinder;

a hollow arc contact mounted on the front end portion of the operating rod so as to face the stationary arc contact and be able to be engaged therewith;

an insulating nozzle mounted on the flange of the movable cylinder so as to surround the movable arc contact with a distance, the insulating nozzle and the movable arc contact forming a first flow path for having an interior of the movable cylinder and an atmosphere in the container filled with the arc extinguishing gas communicate to each other through a first opening made in the flange of the movable cylinder;

a parting plate, provided on a rear end portion of the movable cylinder, and forming a first space surrounded by the outer surface of the operating rod and an inner surface of the movable cylinder, a portion which defines an inner diameter of the parting plate being formed slidable on the outer surface of the stationary supporting tube, and a portion which defines an outer diameter of the parting plate being larger than an outer diameter of the movable cylinder;

a current collecting cylinder disposed to be coaxial with the operating rod, a part of the current collecting cylinder being formed slidable on a portion which defines an outer diameter of the parting plate of the movable cylinder, and having a current collecting plate at a front end portion thereof, which slides on the outer surface of the movable cylinder and being electrically contact therewith, and a supporting plate at a rear end portion thereof, which is fixed to the container and a portion thereof which defines an inner diameter being formed slidable on the operating rod, the current collecting cylinder forming a second space together with the parting plate, the stationary supporting tube and the supporting plate, having a plurality of grooves in an inner surface of a central portion thereof in an axial direction of the operating rod, engraved to be parallel to the axial direction, and a plurality of communication holes piercing from an inner surface to an outer surface at a portion of the current collecting cylinder situated between the plurality of grooves and the current collecting plate; and a check valve provided on the parting plate, for making the first space and the second space communicate to each other.

In the gas circuit breaker of the second aspect of the invention, only the gas in the second space (compression room space) is compressed during the electrode opening operation. At the initial stage of the electrode opening operation, the check valve provided on the parting plate situated at the rear end of the movable cylinder is open. The effect that the gas flows into the first space (thermal pressure elevation room space), and also the effect that the check valve is closed when the pressure elevation in the thermal pressure elevation room space is increased due to the arc, so as to inhibit the gas flow from the thermal pressure elevation room space to the compression room space, can be obtained as in the case of the first aspect of the invention. Further, in the middle of the procedure of the electrode opening operation, when the outer diameter portion of the parting plate at the rear end of the movable cylinder reaches the front end of the grooves made in the current collecting cylinder, the compression room space communicates to the gas-filled atmosphere via the notch grooves made at the front end of the current collecting cylinder, the communication holes of the cylinder and the like, thus decreasing the pressure elevation. At the final stage of the electrode opening operation, the communication between the compression room space and the gas-filled atmosphere is closed, and therefore the gas pressure is increased. Consequently, the check valve is opened, and thus the gas is supplied from the compression room space to the thermal pressure elevation room space. This effect is similar to that of the first aspect of the invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to accompanying drawings.

(First Embodiment)

Figure 3:
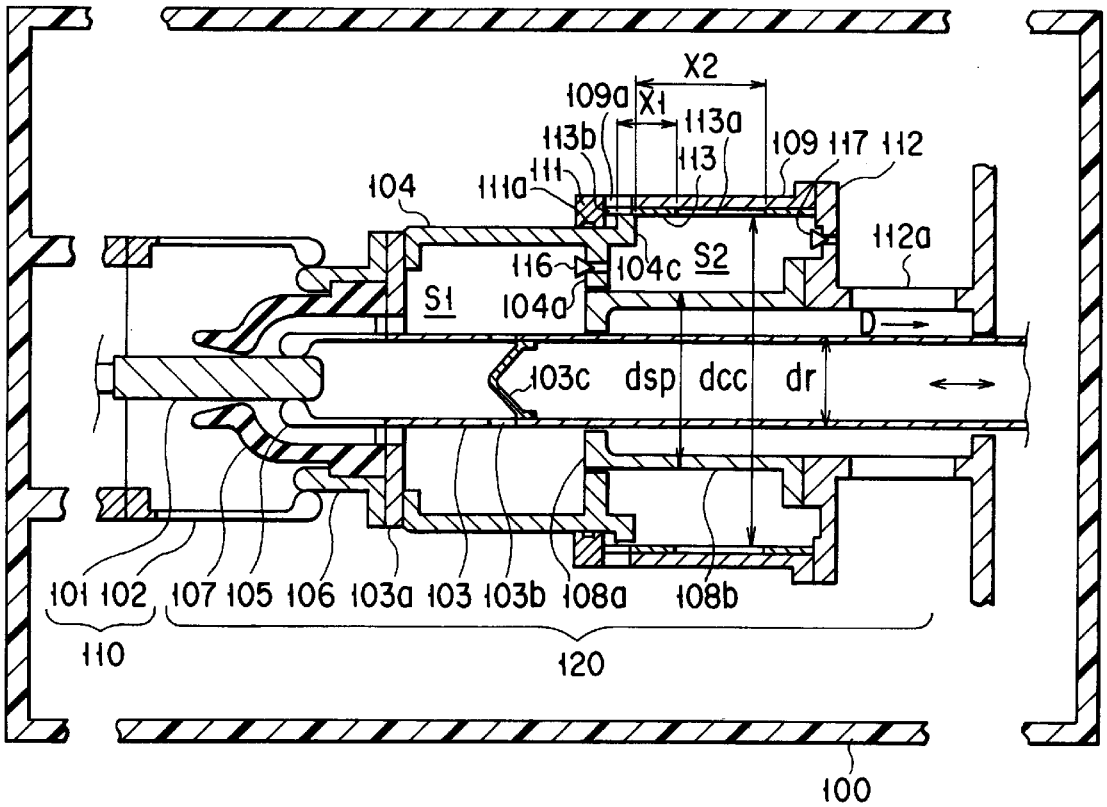
FIG. 3 is a cross sectional view of a gas circuit breaker, which is in an electrode close operation.
Figure 4A:
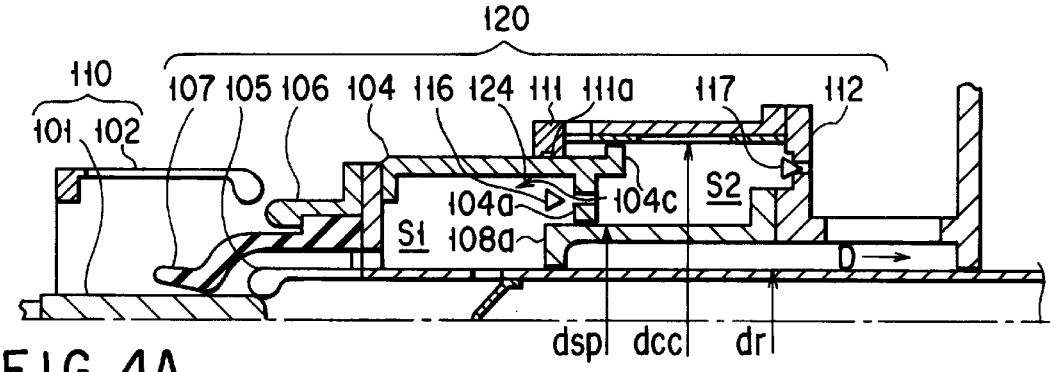
FIGS. 4A to 4C are diagrams illustrating states of the electrode opening operation of the gas circuit breaker shown in FIG. 3 by step, FIG. 4A showing a cross section of the upper half of the breaker in an initial stage of the electrode opening operation, FIG. 4B showing a cross section of the breaker in a middle stage of the electrode opening operation, and FIG. 4C showing a section of the breaker in a last stage of the electrode opening operation.
Figure 4B:
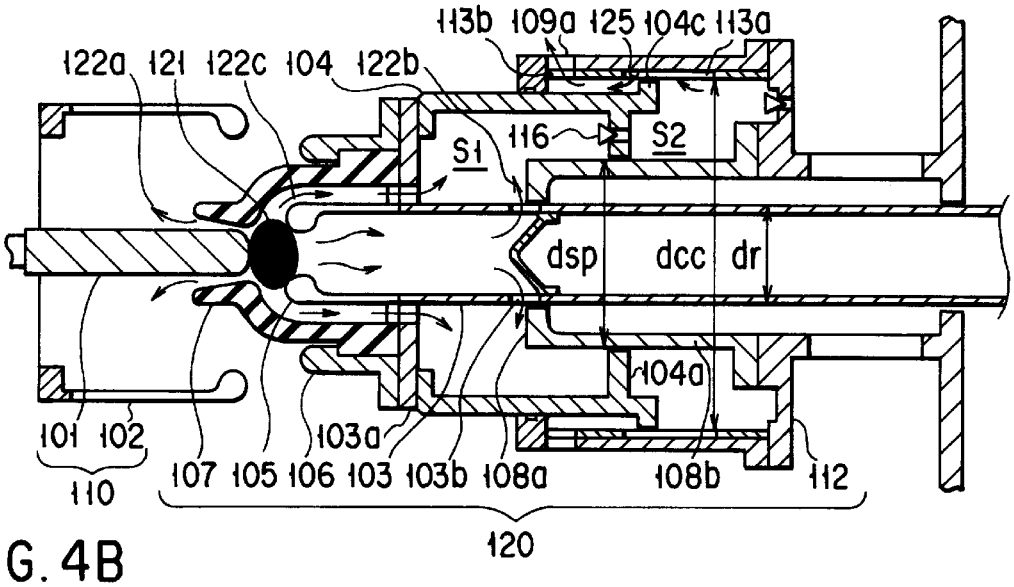
Figure 4C:
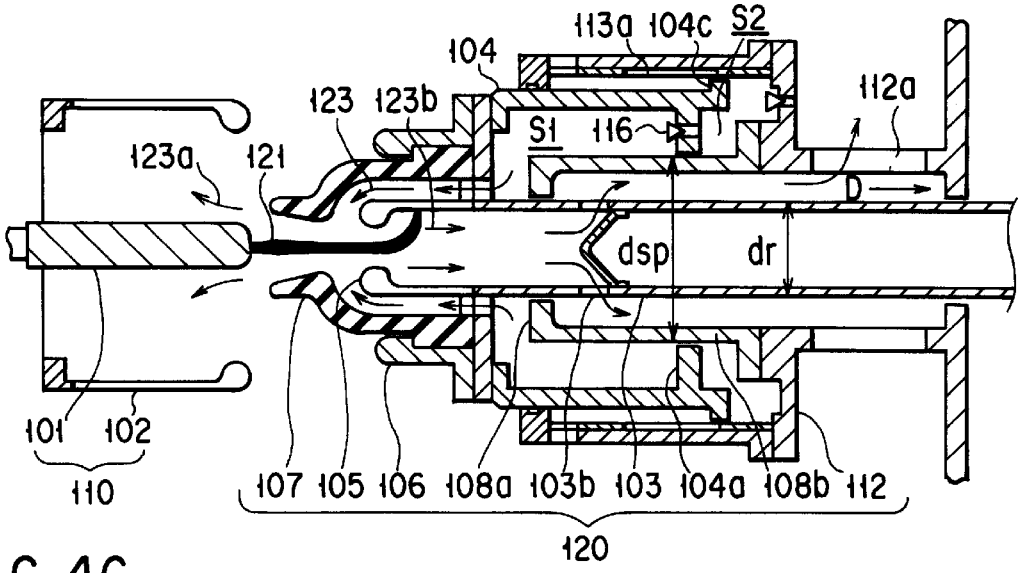
Figure 5:
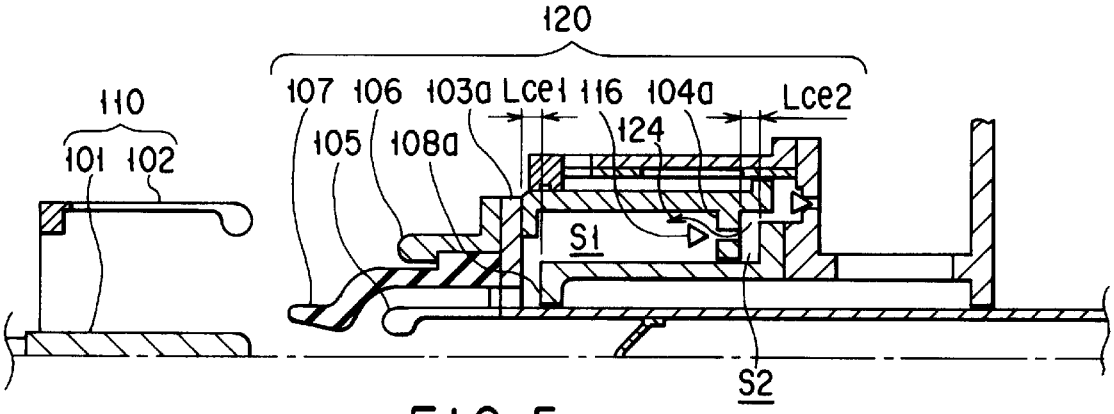
FIG. 5 is a cross section of the upper half of the gas circuit breaker of FIG. 3 in a state in which the electrode opening operation is completed.

FIG. 3 is a cross sectional view of a gas circuit breaker according to the first embodiment of the present invention, FIGS. 4A to 4C are cross sectional views showing the initial, middle and final stages of the electrode opening operation of the gas circuit breaker shown in FIG. 3, and FIG. 5 is a cross sectional view showing the state in which the electrode opening operation is completed. It should be noted that with regard to the position of the movable contact section, the stationary contact section side is defined as the forward side, and the opposite side is defined as the backward side.

As can be seen in FIG. 3, a stationary contact section 110 and a movable contact section 120 are arranged such as to face each other within a container 100 filled with an arc-extinguishing gas. The stationary contact section 110 consists of a stationary arc contact 101 and a stationary conductive contact 102 disposed around the contact 101.

The movable contact section 120 includes a hollow operating rod 103 having a donut-shaped flange 103*a* at its front end portion, and a movable cylinder 104 connected to the back of the flange 103*a* of the operating rod 103 and having a parting plate at its rear end portion, consisting of a small inner diameter portion 104*a* and a large outer diameter portion 104*c*.

The movable contact section 120 further includes a stationary current collecting cylinder 109 supported by a supporting member 112. The current collecting cylinder 109 has a diameter larger than that of the movable cylinder 104, and therefore the movable cylinder 104 can be inserted to or removed from the cylinder. The cylinder 109 has a current collecting plate 111 to which a current collecting contact 111*a* is mounted at its front end portion, and the current collecting plate 111 is brought into contact with the outer surface of the movable cylinder 104 as it slides thereon, so as to form a conductive path of a low electrical resistance. Further, the large outer diameter portion 104*c* of the parting plate is designed to slide on the inner surface of the current collecting cylinder 109.

The current collecting cylinder 109 has an inside cylinder 113 fitted in the interior of the cylinder 109. The inside cylinder 113 has a plurality of grooves 113*a* at a middle section in the axial direction, which pierce from the inner surface to the outer surface, and a notch groove or a communication hole 113*b* at a distal end portion in the axial direction, which pierces from the inner surface to the outer surface. In the vicinity of the current collecting plate 111 at the distal end of the current collecting cylinder 109, another communication hole 109*a* which is aligned with the communication hole 113*b* is made. Further, inside the current collecting cylinder 109, a piston plate 108*a* having a supporting tube 108*b* fixed to the supporting plate 112, at its back, is provided.

Further, in the forwarding side of the flange 103*a* of the operating rod 103, a hollow movable arc contact 105 is provided to be connected to the flange 103*a*. The movable arc contact 105 has a structure in which a plurality of fingers are arranged to be apart from each other on an imaginary cylinder. In the cross section shown in FIG. 3, a projection view of a finger is shown, because the cross section is taken along a gap portion between fingers. Around the movable arc contact 105, the movable conductive contact 106 and an insulating nozzle 107 which surrounds the movable arc contact 105 are disposed.

In the movable contact section 120, the inner diameter of the piston plate 108*a* is set substantially the same as (slightly larger than) an outer diameter $d_r$ of the operating rod 103, and an outer diameter $d_{sp}$ of the piston plate 108*a* is set substantially the same as (slightly smaller than) an inner diameter of the small inner diameter portion 104*a* (to be called parting plate, hereinafter) of the rear end of the movable cylinder 104. In the electrode close state, the piston plate 108*a* and the supporting tube 108*b* are inserted to the inner diameter section of the small inner diameter portion 104*a* of the parting plate. During the electrode opening operation, the outer surface of the operating rod 103 slides on the inner diameter section of the piston plate 108*a*, and the inner diameter section of the small inner diameter section 104*a* of the parting plate slides on the outer diameter portions of the piston plate 108*a* and the supporting tube 108*b* for the piston plate.

The outer diameter of the large outer diameter portion 104*c* of the parting plate is set substantially the same as (slightly smaller than) an inner diameter $d_{cc}$ of the inside cylinder 113. Thus, the large outer diameter portion 104*c* is inserted to the inner diameter portion of the inside cylinder 113, and during the opening/closing operation, the large outer diameter portion 104*c* slides on the inner diameter portion of the inside cylinder 113.

With the above-described structure, on the front side of the flange 103*a* of the operating rod 103 and the small inner diameter portion 104*a* of the parting plate, the movable cylinder 104, a thermal pressure elevation room space $S_1$ is formed to be surrounded by the small inner diameter portion 104*a* of the parting plate, the piston plate 108*a*, the supporting tube 108*b* and the operating rod 103. On the rear side of the small inner diameter portion 104*a*, a compression room space $S_2$ is formed to be surrounded by the inside cylinder 113, the small inner diameter portion 104*a* and the large outer diameter portion 104*c* of the parting plate, the supporting tube portion 108*b* and the supporting plate 112.

Further, on the small inner diameter portion 104*a* of the parting plate, a check valve 116 which allows the gas to flow from the compression room space $S_2$ to the thermal pressure elevation room space $S_1$ and inhibits the gas flow which is opposite thereto is provided. On the supporting plate 112, a check valve 117 which allows the gas to flow from the gas-filled atmosphere to the compression room space $S_2$ and inhibits the gas flow which is opposite thereto is provided. In the middle portion in the axial direction of the inside cylinder 113*a* which constitutes the compression room space $S_2$, a plurality of grooves 113*a* which pierce from the inner surface to the outer surface are made. In the front end portion of the inside cylinder 113, a plurality of notch grooves 113*b* or communicating holes 109*a* are made to pierce from the inner surface to the outer surface.

Figure 1:
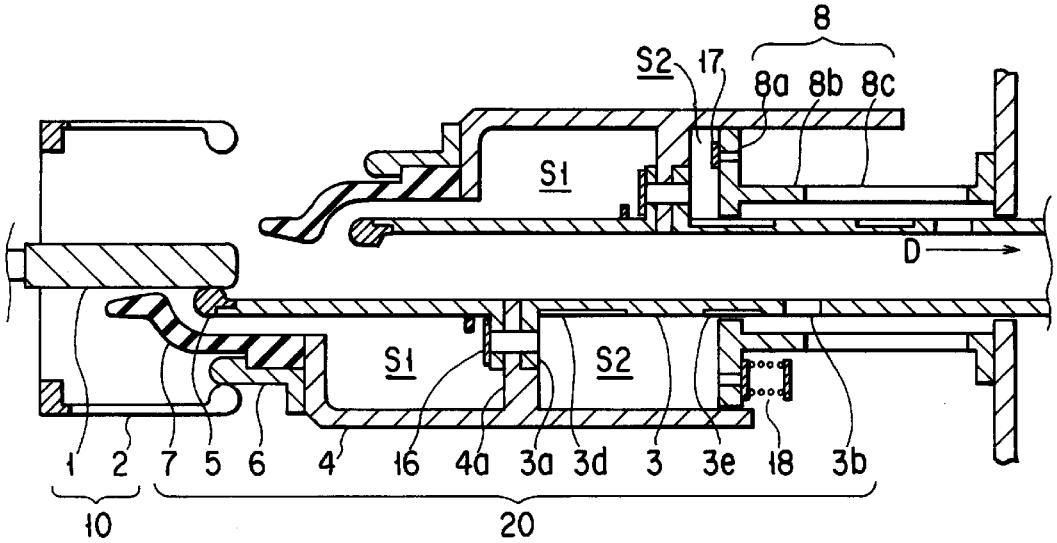
FIG. 1 PRIOR ART
FIG. 1 is a cross sectional view showing the main part of a conventional gas circuit breaker, the lower half of which with respect to the center line, illustrates the electrode close state, and the upper half of which from the center line, illustrates the state in which the interruption is completed.
Figure 2:
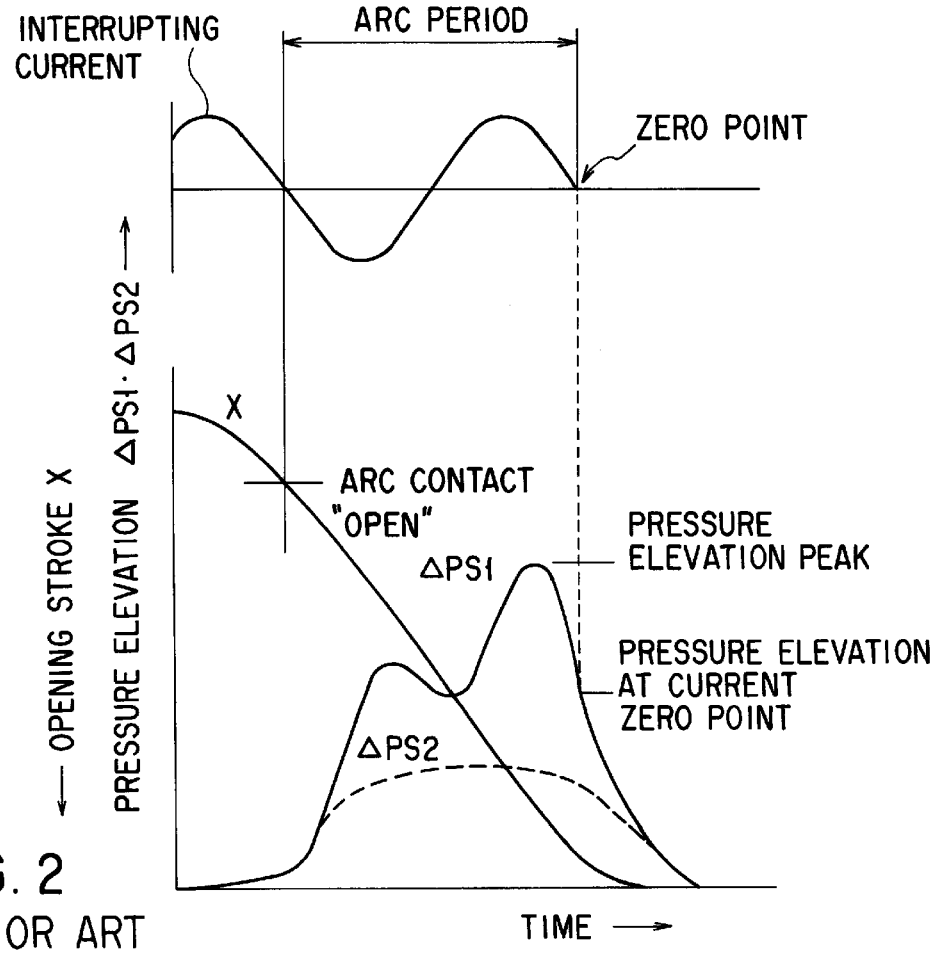
FIG. 2 PRIOR ART
FIG. 2 is a characteristic diagram showing the characteristics of the conventional gas circuit breaker, such as the interruption current, the electrode movement distance (the electrode opening stroke) when the electrode is opened, and the pressure elevation in the thermal pressure elevation room space.

The locations and length of the grooves 113*a* are adjusted such that the compression room space $S_2$ communicates to the gas-filled atmosphere via the notch grooves 113*b* of the inside cylinder 113 and the communicating holes 109*a* of the current collecting cylinder, in a short time period after the stationary arc contact and the movable arc contact are separated from each other (at the position where the movement distance of the movable section is $X_1$ in FIG. 3), during the electrode opening operation of the breaker, and closes its communication at the position close to the completion of the electrode opening operation (at the position where the movement distance is $X_2$ in FIG. 1).

The operating rod 103 is formed to be reciprocated in its axial direction by means of a driving device (not shown), and the notch grooves 103*b* serving as exhaust holes are made in a further front portion as compared to the conventional case shown in FIG. 1. That is, the exhaust holes 103*b* of the operating rod 103 are formed such that they are situated on the forward side from the piston 108*a* when the piston 108*a* is withdrawn at the most, and the hollow portion of the movable arc contact 105, the hollow portion of the operating rod 103 and the thermal pressure elevation room space $S_1$ communicate to each other in the initial stage of the electrode opening operation which shifts from the state shown in FIG. 4A to that shown in FIG. 4B. In the later stage of the electrode opening operation shown in FIG. 4C, the exhaust holes 103*b* of the operating rod 103 serve to make the hollow portion of the movable arc contact 105 and the hollow portion of the operating rod 103 communicate to the gas-filled atmosphere through the hollow portion formed by the supporting tube 108*b* and the operating rod 103 and the exhaust hole 112*a* of the supporting plate 112.

At a section immediately backward from the exhaust holes 103*b* of the operating rod 103, a gas-flow stopping member 103*c* is provided. The gas-flow stopping member 103*c* is provided to interrupt the flow path from the front portion to the rear portion of the operating rod 103, and to induce the exhaust of the gas from the exhaust holes 103*b*.

Incidentally although not shown in FIG. 3, two conductors each surrounded by a bushing are provided on the container 100, at portions sandwiched by the paired cutaway lines, respectively. Each of the two conductors is connected to a corresponding one of the stationary contact section 110 and the supporting member 112 in contact with the current collecting cylinder 109, thereby serving as an outer electrode for an outer current path to be interrupted by the circuit breaker.

Next, the operation of the first embodiment will now be described with reference to FIGS. 3 to 6.

First, in the electrode closing state shown in FIG. 3, a current flows from the stationary conductive contact 102 of the stationary contact section 110 to the movable conductive contact 106 of the movable conductive contact section 120, and further flows to the current collecting cylinder 109 via the current collecting contact 111*a*. In the electrode close state, when a driving force from the driving device (not shown) acts in the direction indicated by allow D, and the operating rod 103 moves in the arrow direction, the movable section including the operating rod 103, that is, the operating rod 103, the movable cylinder 104 connected thereto, the movable arc contact 105, the movable conductive contact 106 and the nozzle 107, moves as an integral unit in the direction indicated by arrow D.

By the electrode opening operation, the gas in the compression room space $S_2$ is compressed by a compression cross section area $\pi(d_{cc}^2-d_{sp}^2)/4$, and the gas in the compression room space $S_1$ is compressed by a compression cross section area $\pi(d_{sp}^2-d_r^2)/4$. In the electrode opening operation, first, the stationary conductive contact 102 and the movable conductive contact 106 are separated from each other, and after some delay, the stationary arc contact 101 and the movable arc contact 105 are separated, thus generating an arc between the stationary arc contact 101 and the movable arc contact 105.

FIG. 4A illustrates a moment when the stationary arc contact 102 and the movable arc contact 105 are separated from each other. From the start of the electrode opening operation to the state shown in FIG. 4A, a large acceleration is acting on the movable section, and therefore the check valve 116 is opened. Further, when the compression cross section area $\pi(d_{cc}^2-d_{sp}^2)/4$ of the compression room space $S_2$ is set larger than the compression cross section area $\pi(d_{sp}^2-d_r^2)/^4$ of the thermal pressure elevation room space $S_1$, and the "the initial volume/the reduced volume by the movement of the piston plate 8*a* at the maximum distance" in the thermal pressure elevation room space $S_1$, is set larger than "the initial volume/the reduced volume by the movement of the parting plate 104*a* and 104*c* at the maximum distance" in the compression room space $S_2$", the gas flows from the compression room space $S_2$ to the thermal pressure elevation room space $S_1$ as indicated by arrow 124 in FIG. 4A in the initial stage of the electrode opening operation, thus increasing the initial gas density of the thermal pressure elevation room space $S_1$.

As the electrode opening operation proceeds, the distance between the stationary arc contact 101 and the movable arc contact 105 becomes long as can be seen in FIG. 4B, and when the instantaneous current value is large, an arc 121 has high energy and a great amount of the high-temperature gas is generated. In the case where the nozzle 107 is not completely opened as shown in FIG. 4B, the high-temperature gas from the arc blows out of the nozzle 107 as indicated by a high-temperature gas flow 122*a*. At the same time, the high-temperature gas creates a high-temperature gas flow 122*c* passing through the flow path between the inner side of the nozzle 107 and the outer side of the movable arc contact 105, and a high-temperature gas flow 122*b* passing through the hollow portions of the movable arc contact 105 and the operating rod 103, and these gas flows enter the thermal pressure room space $S_1$ through the openings made in the flange 103*a* and the exhaust holes 103*b*, thus increasing the temperature of the interior and raising the pressure.

Being assisted by the compression by the piston plate 108*a* in addition to the raising of the pressure by the high-temperature gas flow, the pressure elevation value of the thermal pressure elevation room space $S_1$ becomes higher than the pressure elevation value of the compression room space $S_2$ within a short time. At this point, due to the reaction force created by the pressure elevation in the compression room space $S_2$, the acceleration of the movable section is already small. Consequently, as shown in FIG. 4B, the check valve 116 is closed easily due to the difference in the pressure between the thermal pressure elevation room $S_1$ and the compression room space $S_2$, and thus the gas flow from the compression room space $S_2$ to the thermal pressure elevation room space $S_1$ is inhibited.

Even in the case where the electrode opening operation proceeds further from the state shown in FIG. 4B, and the exhaust holes 103*b* of the operating rod 103 come to the rear portion with respect to the piston plate 108*a*, the high-temperature gas flow 122*c* to the thermal pressure elevation space $S_1$ is maintained if the current value is high. Thus, the temperature in the thermal pressure elevation room $S_1$ is increased, and a high pressure elevation value is maintained.

In the meantime, in accordance with the pressure elevation in the compression room space $S_2$ is drastically increased by the arc 121, the large inner diameter portion 104*c* of the partition wall reaches the front end portion of the groove 113*a* made in the middle portion of the inside cylinder 113 (that is, the distance of the movement of the movable section becomes $X_1$) as shown in FIG. 4B, and the compression room chamber $S_2$ communicates to the gas-filled atmosphere through a gap between the inner diameter of the inside cylinder 113 and the outer diameter of the movable cylinder 104, the notch grooves 113*b* made in the front distal end of the inside cylinder 113 and the communication hole 109*a* of the current collecting cylinder 109. Consequently, the gas in the compression room space $S_2$ is released to the gas-filled atmosphere as indicated by arrow 125, and the pressure in the compression room space $S_2$ is decreased. Therefore, the reaction force to the driving force is decreased, and the electrode opening operating can proceed with low energy.

FIG. 4C shows a state in which the electrode opening operation further proceeds, and reaches the stage immediately before the completion of the electrode opening operation. In this state, the nozzle 107 is fully open, and the exhaust holes 103*b* of the operating rod 103 are opened to the rear portion of the piston plate 108*a*. Consequently, when the current value becomes small, that part of the high-temperature gas which fills the throat section of the nozzle 107 vanishes, and the gas flows out of the thermal pressure elevation room space $S_1$ as indicated by a gas flow 123. The gas flow further becomes a gas flow 123*a* and is sprayed out of the nozzle 107. At the same time, it creates a gas flow 123*b*, which is sprayed to the gas-filled atmosphere after going through the hollow portion of the movable arc contact 105 and the hollow portion of the operating rod 103. In this manner, the arc 121 is cooled down strongly by the gas flows in the two directions, and extinguished at a current zero point, thus interrupting the current.

It should be noted FIG. 4C illustrates a typical state in which a current can be interrupted. From before this state, the nozzle 107 is fully open, and the exhaust holes 103*b* are opened to the rear portion of the piston plate 108*a*. Therefore, the current can be interrupted at that point.

Before the state in which the current can be interrupted, the pressure elevation of the thermal pressure elevation room space $S_1$ is already made sufficiently high by an increase in the density, which takes place in the initial stage of the electrode opening operation, and the compression effect by the piston plate 108*a*, in addition to the main cause which is the temperature increase due to the high-temperature gas from the arc flowing into the space $S_1$. The breaker according to the first embodiment differs from the conventional gas circuit breaker shown in FIG. 1 in the respect that the degree of decreasing of the pressure from the pressure elevation value (pressure elevation peak value), which reaches at the maximum in the vicinity of the peak of the current value, to the pressure elevation value at the current zero point, is low due to the effect that the thermal pressure elevation room space $S_1$ is compressed by the piston plate 108*a*. With this effect, a high pressure elevation value can be obtained at the current zero point, thus obtaining a high current interrupting performance.

In the state shown in FIG. 4C, which is immediately before the completion of the electrode opening operation, the large outer diameter portion 104*c* of the parting plate goes beyond the rear end portion of the grooves 113*a* made in the middle portion of the inside cylinder 113 in the axial direction (the distance of the movement of the movable section is more than $X_2$ shown in FIG. 3), and the communication between the compression room space $S_2$ and the gas-filled atmosphere is closed. Therefore, after that, the pressure in the compression room space $S_2$ once again increases.

FIG. 5 shows a state in which the electrode opening operation further proceeds and reaches the position of the completion of the electrode opening operation. In this state, the distance between the flange 103*a* of the operating rod and the piston plate 108*a* in the thermal pressure elevation room space $S_1$ is defined as $L_{CE1}$, and the distance between the small diameter portion 104*a* of the parting plate and the rear end of the compression room space $S_2$ is defined as $L_{CE2}$. These distances are each set to be the minimum value which can assure a mechanical allowance for avoiding a collision, or higher.

After the current is interrupted in the state shown in FIG. 4C, the gas in the thermal pressure elevation room space $S_1$ keeps on flowing out from the nozzle 107. Therefore, the pressure in the space $S_1$ becomes close to the pressure in the gas-filled atmosphere, and the density is decreased. However, when the pressure elevation value of the compression room space $S_2$ which is once again compressed becomes higher than the pressure elevation value of the thermal pressure room space $S_1$, the check valve 116 is opened, and the gas in the compression room space $S_2$ flows into the thermal pressure elevation room space $S_1$. Thus, the density in the thermal pressure elevation room $S_1$ is increased. Due to this effect, the performance of the high-speed electrode re-opening interruption, that is, immediately after the first interruption, the electrode being closed, and the current being interrupted immediately thereafter, can be enhanced. Further, the pressure elevation in the compression room space $S_2$ immediately before the completion of the electrode opening operation, is effective for the slow down the speed of the movable section.

Figure 6:
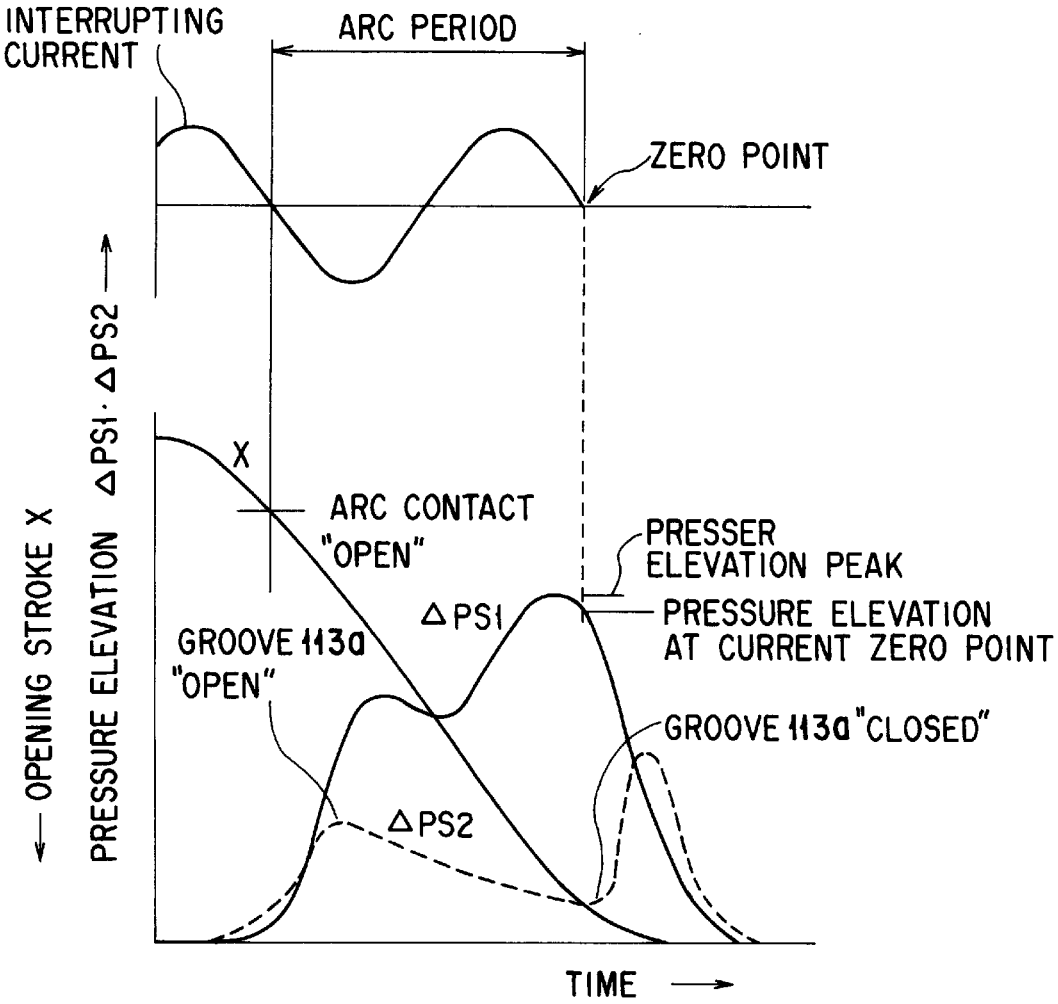
FIG. 6 is a characteristic diagram showing the characteristics of the gas circuit breaker shown in FIG. 3, such as the interruption current, the electrode movement distance (the electrode opening stroke) when the electrode is opened, and the pressure elevation in the thermal pressure elevation room space.

The results of the calculations for the movement position (stroke) of the movable section at the electrode opening operation, the pressure elevation of the thermal pressure elevation room space $S_1$ and the pressure elevation of the compression room space $S_2$ are illustrated in FIG. 6.

As can be seen in FIG. 6, until immediately after the two arc contacts are separated from each other, the pressure elevation of the pressure room space $S_2$ is higher than that of the thermal pressure elevation room space $S_1$, and therefore the gas is supplied from the compression room space $S_2$ to the thermal pressure elevation room space $S_1$. After the generation of an arc, the pressure of the thermal pressure elevation room space $S_1$ increases rapidly, and the pressure elevation of the compression room space $S_2$ is already decreased to a low value as the space $S_2$ communicate to the gas-filled atmosphere via the grooves 113*b*. The arc time is long as about 20 ms; however the pressure elevation in the thermal pressure elevation room space $S_1$ at the current zero point, is maintained at a value close to the pressure elevation peak value. Further, it is clearly observed that immediately before the completion of the electrode opening operation, the pressure in the compression room space $S_2$ increases rapidly, and the gas is supplied to the terminal pressure elevation room space $S_1$.

Further, after the state shown in FIG. 5, that is, the completion of the electrode opening operation, the electrode closing operation is started. Then, when the pressure in the compression room space $S_2$ is decreased, the check valve 117 is opened so that the gas is supplied to the compression room space $S_2$ from the gas-filled atmosphere, thereby preventing the lowering of the pressure in the compression room space $S_2$. Meanwhile, when the pressure of the thermal pressure elevation room space $S_1$ begins to decrease, the check valve 116 is opened so that the gas is supplied to the thermal pressure elevation room space $S_1$ from the compression room space $S_2$, thereby preventing the lowering of the pressure in the thermal pressure elevation room space $S_1$.

As described above, in the first embodiment, the effect of increasing the density of the gas in the initial stage of the electrode opening operation and the compression effect of the small diameter piston portion are added to the pressure elevation effect achieved by the thermal energy of the arc, and therefore a high pressure elevation in the thermal pressure elevation room space $S_2$ can be achieved. In particular, the addition of the compression effect by the piston having a small diameter has made it possible to suppress the decrease in the pressure elevation at the current zero point, and thus a high interruption performance can be obtained.

Further, until immediately before the completion of the electrode opening operation after the state shown in FIG. 4B, the pressure elevation in the compression room space $S_2$ can be maintained at a low value, and therefore the reaction force to the driving force can be decreased. Consequently, the driving energy can be reduced while obtaining a high interruption performance due to a high pressure elevation in the thermal pressure room space $S_1$.

(Second Embodiment)

Figure 7:
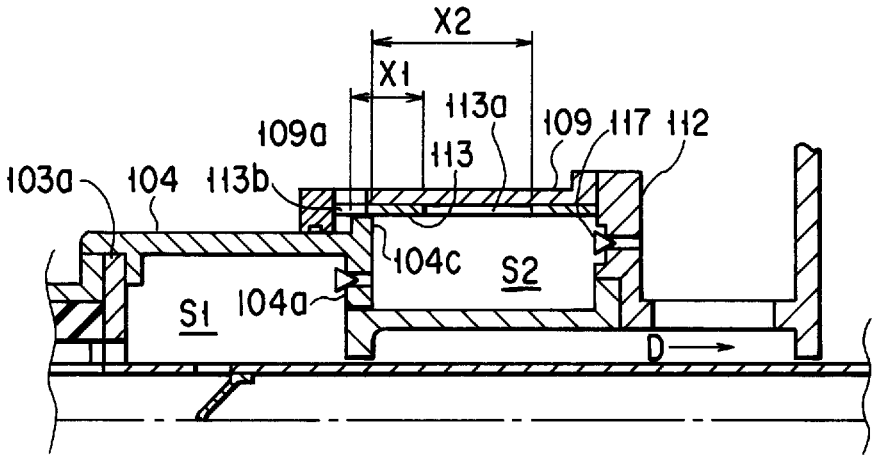
FIG. 7 is a cross section of an upper half of the main portion of a gas circuit breaker, which is in an electrode close state, according to the second embodiment of the present invention.

FIG. 7 is a cross sectional view of the main portion of a gas circuit breaker according to the second embodiment of the present invention. In connection with embodiments from this one onwards, similar structural members to those of the first embodiment will be designated by the same reference numerals, and the explanations therefor will not be repeated.

As can be seen in FIG. 7, in the second embodiment, the rear end of the movable cylinder 104, that is, the small inner diameter portion 104*a* of the parting plate, is pulled backwards, or the large outer diameter portion 104*c* of the parting plate is pushed forwards (accordingly the current collecting plate 111 at the distal end of the current collecting cylinder 9 proceeds), such that the rear end surface of the small inner diameter portion 104*a* and the rear end surface of the large outer diameter portion 104*c* make the same plane. Therefore, the front end surface of the piston plate 108*a* is situated at substantially the same position as that of the front end surface of the small inner diameter portion 104 of the parting plate in full retreat state. In this case, the large outer diameter portion 104*c* of the parting plate is pushed forwards. Here, in order to assure the distance of sliding of the outer surface of the movable cylinder on the current collecting plate 111 at the distal end of the current collecting cylinder 109, such a structure that the movable cylinder 104 covers the flange 103*a* of the operating rod is made. The portions other than the periphery of the small inner diameter portion 104*a* of the parting plate and the large outer diameter portion 104*c*, are the same as those of the first embodiment, and therefore the explanations therefor will be omitted here.

Next, the operation of the second embodiment of the present invention will now be described.

The gas in the thermal pressure elevation room space $S_1$ is compressed by a compression cross section area $\pi(d_{sp}^2-d_r^2)/4$, and the gas in the compression room space $S_2$ is compressed by a compression cross section area $\pi(d_{cc}^2-d_{sp}^2)/4$. The course of the pressure elevation in each of the thermal pressure elevation room space $S_1$ and the compression room space $S_2$, and the operation of the check valve 116, in the interruption operation from the separation of the arc contacts and the generation of an arc, to the interruption, that is, the completion of the interruption operation, and the operations of the check valves 116 and 117 in the electrode closing operation are similar to those of the first embodiment, shown in FIGS. 4A to 4C. With the second embodiment, the characteristic of the pressure elevation shown in FIG. 6 can be obtained. That is, similar to the first embodiment, in the second embodiment, the effect of increasing the density of the gas in the initial stage of the electrode opening operation and the compression effect of the piston portion are added to the pressure elevation effect achieved by the thermal energy of the arc, and therefore a high pressure elevation can be achieved. Further, it is possible to suppress the decrease in the pressure elevation at the current zero point, and thus a high interruption performance can be obtained.

Further, until immediately before the completion of the electrode opening operation, the pressure elevation in the compression room space $S_2$ can be maintained at a low value by means of the grooves 113*a*, and therefore the reaction force to the driving force can be decreased. Consequently, the driving energy can be reduced while obtaining a high interruption performance due to a high pressure elevation in the thermal pressure room space $S_1$. Further, as in the first embodiment, the pressure of the compression room space $S_2$ is elevated immediately before the completion of the electrode opening operation, and the check valve 116 is opened to allow the gas flow from the compression room space $S_2$ to the thermal pressure elevation room space $S_1$, thus recovering the density in the thermal pressure elevation room space $S_1$. Consequently, the performance of the high-speed electrode re-closing interruption can be enhanced. Furthermore, the pressure elevation of the compression room space $S_2$ immediately before the completion of the electrode opening operation can be utilized for the slow down of the speed of the movable section, as in the first embodiment.

According to the second embodiment of the present invention, the structure of the movable cylinder can be simplified, and therefore the production cost can be reduced.

(Third Embodiment)

Figure 8:
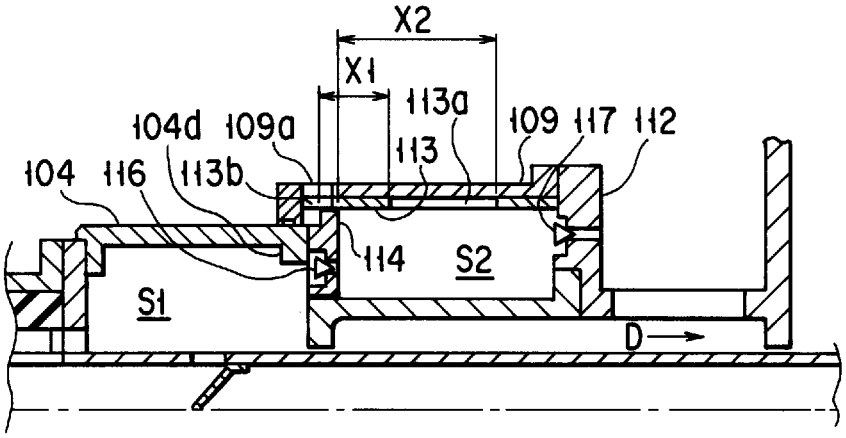
FIG. 8 is a cross section of an upper half of the main portion of a gas circuit breaker, which is in an electrode close state, according to the third embodiment of the present invention.

FIG. 8 is a cross sectional view of the main portion of a gas circuit breaker according to the third embodiment of the present invention.

As shown in FIG. 8, in the third embodiment, the section which includes the parting plates 104*a* and 104*b*, is set as a member 114 (to be called a rear end slide plate) separate from the movable cylinder 104, and a check valve 116 is provided at the rear end portion of the movable cylinder 104 and within the rear end sliding plate 114 so as to allow the gas from the compression room space $S_2$ to the thermal pressure elevation room space $S_1$. The portions other than the periphery of the movable cylinder 104 and the rear end slide plate 114 are the same as those of the second embodiment, and therefore the explanations therefor will not be repeated.

The third embodiment has a structure more simple than those embodiments described above, in terms of the portion of the check valve 116. Further, the rear end slide plate 114 is formed as a small-sized member separate from the movable cylinder 104, and therefore the process for structuring the check valve 116 is easy. At the same time, the rear end portion of the movable cylinder 104, which designed to hold the rear end slide plate 114, can be made to serve as a drop-off preventing member for the elements which constitute the check valve, that is a spring or the like, which is not shown.

As described, according to the third embodiment, in addition to the same operational effects achieved by the first embodiment, the simplification of the entire structure of the gas circuit breaker and the reduction of the production cost can be achieved.

(Fourth Embodiment)

Figure 9:
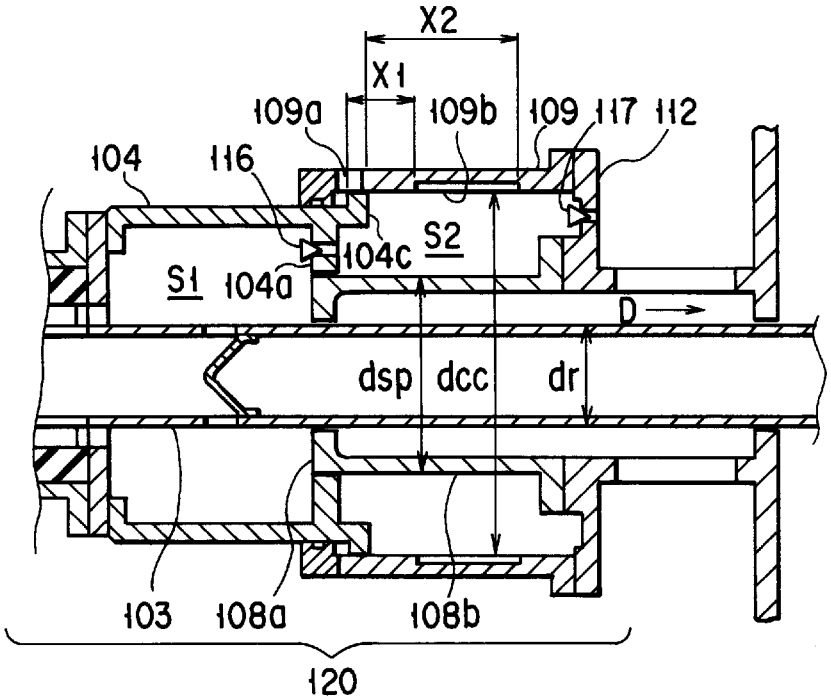
FIG. 9 is a cross section of an upper half of the main portion of a gas circuit breaker, which is in an electrode close state, according to the fourth embodiment of the present invention.

FIG. 9 is a cross sectional view of the main portion of a gas circuit breaker according to the fourth embodiment of the present invention.

As can be seen in FIG. 9, in the fourth embodiment, the current collecting cylinder and the inside cylinder fitted thereinto, of the first embodiment are formed as an integral unit as a current collecting cylinder 109, and a plurality of grooves 109*b* are provided in the middle portion in the axial direction, of the inner diameter portion of the current collecting cylinder 109, such that the grooves do not penetrate to the outer diameter portion. Further, a plurality of communication holes 109*a* which pierce through from the inner diameter to the outer diameter are made in the section ahead of the grooves 109*b*. With this structure, the outer diameter portion of the large outer diameter portion 104*c* of the parting plate slides on the inner diameter portion of the current collecting cylinder 109. The section other than the periphery of the current collecting cylinder 109 is the same as that of the first embodiment, and therefore the explanation therefor will not be repeated here.

As described above, according to the fourth embodiment, in addition to the advantage obtained by the first embodiment, the following advantage can be achieved. That is, since a plurality of grooves 109*b* are provided in the middle portion in the axial direction, of the inner diameter portion of the current collecting cylinder 109, such that the grooves do not penetrate to the outer diameter portion, the number of parts can be decreased and the structure is simplified, although it entails a slightly difficult process of the grooves as compared to the processing of the communication holes 113*a* of the inside cylinder in the first to third embodiment.

(Fifth Embodiment)

Figure 10:
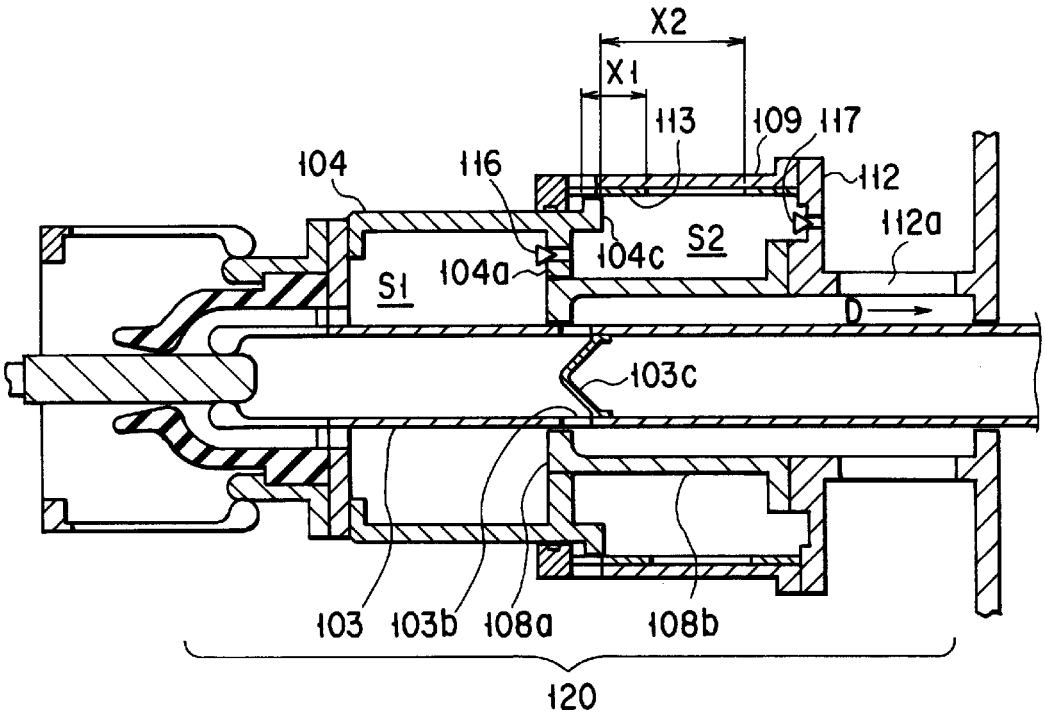
FIG. 10 is a cross section of an upper half of the main portion of a gas circuit breaker, which is in an electrode close state, according to the fifth embodiment of the present invention.

FIG. 10 is a cross sectional view of the main portion of a gas circuit breaker according to the fifth embodiment of the present invention.

As can be seen in FIG. 10, in the fifth embodiment, the exhaust holes 103*b* of the operating rod 103 are situated in a section behind the piston 108*a* from the time of the electrode closing state, or move during the electrode opening operation to reach a section behind the piston 108*a* at latest just after the separation of the stationary arc contact 101 and the movable arc contact 105 from each other, thus communicating to the hollow portion of the operating rod 103 and the gas-filled atmosphere. The portion other than the periphery of the current collecting cylinder 109 is the same as that of the first embodiment, and therefore the explanation therefor will not be repeated here.

As described above, according to the fifth embodiment, the high-temperature gas, which flows to the hollow portion of the operating rod 103 from the generated arc through the hollow portion of the movable arc contact 105 after the separation of the stationary arc contact 101 and the movable arc contact 105 from each other, does not flow into the thermal pressure elevation room space $S_1$, but is discharged through the exhaust holes 103*b* of the operating rod 103 immediately to the hollow portion of the supporting tube 108*b*, and discharged to the gas-filled atmosphere via the exhaust holes 112*a* of the supporting plate 112. Therefore, the pressure elevation effect of the thermal pressure elevation room space $S_1$ due to the heat of the arc is not as high as those of the first to fourth embodiments, or the pressure elevation is lower. However, the effect which can be achieved from the point that an arc is generated between the stationary arc contact 101 and the movable arc contact 105 as they are separated by the electrode opening operation, then the arc is extinguished, to the completion of the electrode opening operation, is the same as that of the first embodiment.

Further, a high pressure elevation which involves a less pressure decrease at the current zero point can be achieved in the thermal pressure elevation room space $S_1$. At the same time, the pressure in the compression room space $S_2$ is maintained at low, and therefore the drive energy can be decreased despite the fact that a high interruption performance can be obtained. Further, at the completion of the electrode opening operation, the gas is supplied from the compression room space $S_2$ to the thermal pressure elevation room space $S_1$, and therefore the performance of the high-speed electrode re-closing interruption can be enhanced.

(Sixth Embodiment)

Figure 11:
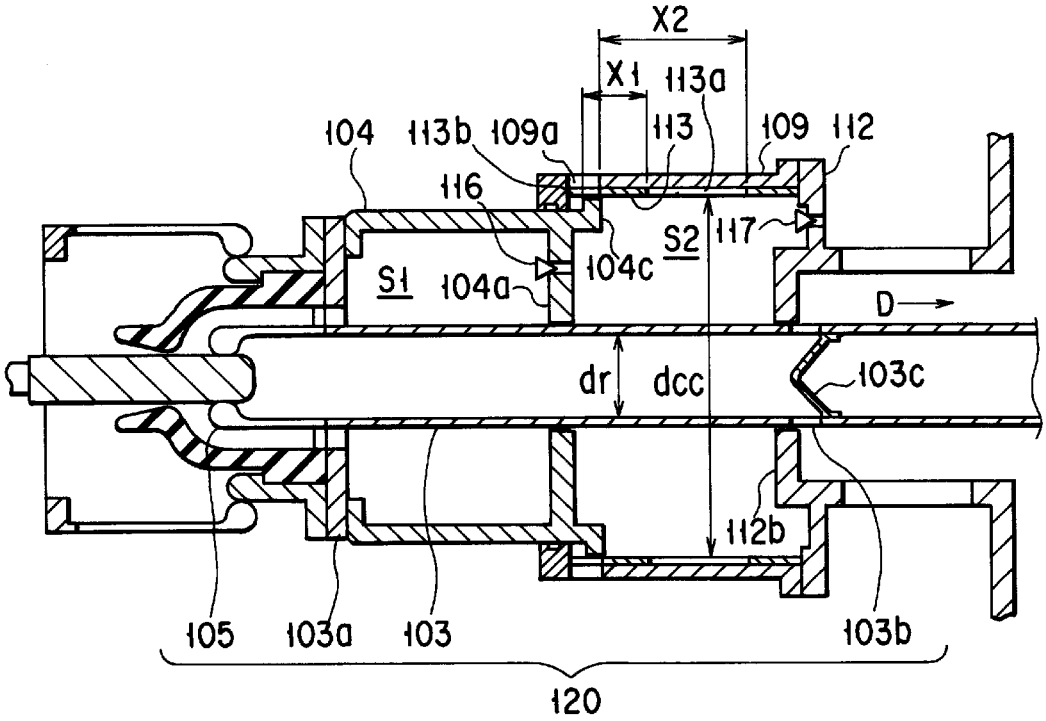
FIG. 11 is a cross section of an upper half of the main portion of a gas circuit breaker, which is in an electrode close state, according to the sixth embodiment of the present invention.

FIG. 11 is a cross sectional view of the main portion of a gas circuit breaker according to the six embodiment of the present invention.

As shown in FIG. 11, according to the sixth embodiment, the inner diameter of the small inner diameter portion 104*a* of the parting plate is set substantially the same as the outer diameter of the operating rod 103, and the piston of the fifth embodiment is eliminated. The compression room space $S_2$ is sealed by the small inner diameter portion 112*b* at the front end of the supporting plate 112, and the operation rod 103 is supported while it is slid. Further, in the electrode close state, the exhaust holes 103*b* of the operating rod 103 are situated at a portion behind the small inner diameter portion 112*a* at the front end of the supporting plate 112, and thus the hollow portion of the movable arc contact 105 and the hollow portion of the operating rod 103 communicate to the gas-filled atmosphere. The portion other than the movable cylinder 104 and the periphery of each of the operating rod 103 and the supporting plate 112 is the same as that of the first embodiment, and therefore the explanation therefor will not be repeated here. More specifically, the explanations on the basis of FIGS. 4A to 4C and 5, can be applied basically to the six embodiment. Further, it is possible that the parting plates 104*a* and 104*c* are formed to have such a structure as shown in FIG. 8, and the current collecting cylinder is formed to have such a structure as shown in FIG. 9.

As described above, according to the sixth embodiment, during the electrode opening operation, only the gas in the compression room space $S_2$ is compressed. In the initial stage of the electrode opening operation, the check valve 116 provided for the small inner diameter portion 104*a* of the parting plate is open, and the same effect in which the gas flows into the thermal pressure elevation room space $S_1$, as that of the first embodiment can be obtained. Further, another effect of the first embodiment, in which when the pressure elevation in the thermal pressure elevation room increases due to an arc, the check valve 16 is closed so as to inhibit the gas flow from the thermal pressure elevation room space $S_1$ to the compression room space $S_2$, can be obtained as well.

Moreover, also in the present invention, in the middle of the procedure of the electrode opening operation, when the movement distance becomes $X_1$ and the larger outer diameter portion 104*c* of the parting plate passes the front end portion of the grooves 113*a* of the inside cylinder 113, the compression room space $S_2$ communicate to the gas-filled atmosphere via the notch grooves 113*b* made in the front end of the inside cylinder 113, the communication holes 109*a* of the current collecting cylinder 109, and the like, thereby decreasing the pressure elevation. When the movement distance of the movable portion reaches $X_2$ in the final stage of the electrode opening operation, the communication between the compression room space $S_2$ and the gas-filled atmosphere is closed. Consequently, the pressure of the gas is increased, and the check valve 116 is opened to make the gas flow from the compression room space $S_2$ to the thermal pressure elevation room space $S_1$. The just-described effect is also similar to that of the first embodiment.

As described above, according to the six embodiment, after the electrode opening operation for a large current interruption, the gas density in the thermal pressure elevation room space $S_1$ is recovered, and therefore a significantly good high-speed electrode re-closing interruption performance can be obtained as compared to the case of the conventional technique. Further, a high braking characteristic for the movable section can be obtained.

It should be noted that the present invention is not limited to the above-described embodiments above, but can be realized in a variety of versions. For example, some or all of the embodiments can be combined together appropriately. Further, the specific structure of a set of the piston and the movable cylinder, or a set of the current collecting cylinder and the inside cylinder, the ratio between these members in cross sectional area, or the ratio between the initial volume and the final volume in each of the thermal pressure elevation room space and the compression room space, can be arbitrarily selected. In addition, the number, shape, size and the like of check valves, exhaustion holes, grooves and the like in each structure can be freely designed.

As described above, with the present invention, the following remarkable advantages can be obtained, as compared to the conventional gas interruption breaker. That is, the pressure in the thermal pressure elevation room space is increased while maintaining the pressure elevation in the compression room at a low value, and the pressure decrease at the current zero point is lowered. Further, the gas is made to flow from the compression room to the thermal pressure elevation room at the completion of the electrode opening operation, so as to prevent the lowering of the gas density in the thermal pressure elevation room. Consequently, it is possible to provide a highly economical gas circuit breaker having a high interruption performance and a small size, which operates with a low driving energy.

Furthermore, according to the present invention, during the electrode opening operation, only the gas in the compression room space is compressed, whereas in the final stage of the electrode opening operation, the communication between the compression room and the gas-filled atmosphere is closed. Therefore, the gas pressure is increased, and the check valve is opened so as to supply the gas from the compression room space to the thermal pressure elevation room space. Consequently, it is possible to provide a highly economical gas circuit breaker having a high interruption performance and a small size, which operates with a low driving energy.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A gas circuit breaker comprising:

a container filled with an arc extinguishing gas;

a stationary contact section arranged in said container to be fixed thereto, said stationary contact section having a stationary arc contact; and a movable contact section arranged to face the stationary arc contact, said movable contact section further comprising:

a hollow operating rod having a front end portion facing said stationary arc contact and a rear end portion situated away from said stationary arc contact, said operating rod having an exhaust hole in the rear end portion thereof, and being capable of moving forwards linearly towards said stationary arc contact and backwards linearly in an opposite direction;

a hollow movable cylinder arranged to be coaxial with said operating rod and separated therefrom, so as to surround a part of an outer surface of said operation rod, which is close to the front end portion, and having a flange fixed to an outer circumferential portion of the front end portion of said operating rod, so as to seal a gap between the outer circumferential portion and an outer surface of said movable cylinder;

a hollow movable arc contact mounted on the front end portion of said operating rod so as to face said stationary arc contact and be able to be engaged therewith;

an insulating nozzle mounted on said flange of said movable cylinder so as to surround said movable arc contact with a distance, said insulating nozzle and said movable arc contact forming a first flow path for having an interior of said movable cylinder and an atmosphere in said container filled with the arc extinguishing gas communicate to each other through a first opening made in the flange of said movable cylinder;

a hollow stationary supporting tube arranged to be coaxial with said operating rod, so as to surround a part of the outer surface of said operating rod, other than the front end portion, said stationary supporting tube having a rear end portion fixed to said container, a front end portion substantially facing the flange of said movable cylinder, and including a piston plate having a portion which defines an inner diameter thereof, being made slidable on the outer surface of said operating rod, and a portion which defines an outer diameter thereof, being flush with an outer surface of said stationary supporting tube, and said stationary supporting tube having a second opening in a portion close to the rear end portion, communicating to the atmosphere of the container filled with the gas, a space defined by an inner surface of said supporting tube, an outer surface of said operating rod and said piston plate to form a second flow path for the gas, and said stationary supporting tube being formed insertable and removable with respect to said movable cylinder;

a parting plate provided on a rear end portion of said movable cylinder, and forming a first space surrounded by the outer surface of said operating rod and an inner surface of said movable cylinder, a portion which defines an inner diameter of said parting plate being formed slidable on the outer surface of said stationary supporting tube, and a portion which defines an outer diameter of said parting plate being larger than an outer diameter of said movable cylinder;

a current collecting cylinder disposed to be coaxial with said operating rod, a part of said current collecting cylinder being formed slidable on a portion which defines an outer diameter of said parting plate of said movable cylinder, having a current collecting plate at a front end portion thereof, which slides on the outer surface of said movable cylinder and being electrically contact therewith, and having a supporting plate at a rear end portion thereof fixed to said stationary supporting tube, said current collecting cylinder forming a second space together with said parting plate, said stationary supporting tube and said supporting plate, having a plurality of grooves in an inner surface of a central portion thereof in an axial direction of said operating rod, engraved to be parallel to the axial direction, and a plurality of communication holes piercing from an inner surface to an outer surface at a portion of said current collecting cylinder situated between the plurality of grooves and the current collecting plate; and a check valve provided on said parting plate, for making the first space and the second space communicate to each other.

2. A gas circuit breaker according to claim 1, wherein during a current interruption operation in which said operating rod is drawn backwards from a state of said movable arc contact being engaged with said stationary arc contact, and said movable arc contact separates from said stationary arc contact, the gas in the second space is compressed by said parting plate, and a high-temperature gas made by an arc generated by said current interruption operation flows into said first space via the first flow path, thereby heating said first space to cause a pressure elevation.

3. A gas circuit breaker according to claim 1, wherein during a current interruption operation, when the portion which defines the outer diameter of said parting plate of said movable cylinder moves to a portion facing the plurality of grooves of said current collecting cylinder, the gas compressed in the second space flows out to the atmosphere of said container filled with the arc-extinguishing gas via the plurality of grooves and the plurality of communicating holes, thereby decreasing a pressure in the second space.

4. A gas circuit breaker according to claim 1, wherein during a current interruption operation, when the portion which defines the outer diameter of said parting plate of said movable cylinder moves beyond and passes a portion facing the plurality of grooves of said current collecting cylinder, the gas in the first space which has an elevated pressure flows out to the atmosphere of said container filled with the arc-extinguishing gas via the first flow path, thereby extinguishing an arc.

5. A gas circuit breaker according to claim 1, wherein said operating rod has a third opening communicating to the second flow path situated between said stationary supporting tube and said operating rod, and a high temperature gas made by an arc flows out to the atmosphere of said container filled with the arc-extinguishing gas via a hollow portion of said operating rod, the third opening and the second flow path.

6. A gas circuit breaker according to claim 1, wherein during a current interruption operation, when the portion which defines the outer diameter of said parting plate of said movable cylinder passes a portion facing the plurality of grooves of said current collecting cylinder, and further moves close to said supporting plate, said check valve provided on said parting plate is opened, and thus the gas in the second space in which a pressure is elevated flows out to the first space.

7. A gas circuit breaker according to claim 1, wherein said parting plate and said movable cylinder are formed integrally.

8. A gas circuit breaker according to claim 1, wherein said parting plate is formed as a separate member from said movable cylinder.

9. A gas circuit breaker according to claim 1, wherein said current collecting cylinder comprises an outer cylinder and an inner cylinder, and the plurality of grooves are formed as opening portions which piercing through the inner cylinder.

10. A gas circuit breaker according to claim 1, wherein said operating rod has a fourth opening which communicates to the second flow path between said stationary supporting tube and said operating rod immediately after separating said stationary arc contact and said movable arc contact from each other, and a high-temperature gas created by an arc generated by a separation of said stationary arc contact and said movable arc contact from each other flows out to the atmosphere of said container filled with the arc-extinguishing gas via a hollow portion of said operating rod, the fourth opening and the second flow path.

11. A gas circuit breaker comprising:

a container filled with an arc extinguishing gas;

a stationary contact section arranged in said container to be fixed thereto, said stationary contact section having a stationary arc contact; and a movable contact section arranged to face the stationary arc contact, said movable contact section further comprising:

a hollow operating rod having a front end portion facing said stationary arc contact and a rear end portion situated away from said stationary arc contact, said operating rod having an exhaust hole in the rear end portion thereof, and being capable of moving forwards linearly towards said stationary arc contact and backwards linearly in an opposite direction;

a hollow movable cylinder arranged to be coaxial with said operating rod and separated therefrom, so as to surround a part of an outer surface of said operation rod, which is close to the front end portion, and having a flange fixed to an outer circumferential portion of the front end portion of said operating rod, so as to seal a gap between the outer circumferential portion and an outer surface of said movable cylinder;

a hollow movable arc contact mounted on the front end portion of said operating rod so as to face said stationary arc contact and be able to be engaged therewith;

an insulating nozzle mounted on said flange of said movable cylinder so as to surround said movable arc contact with a distance, said insulating nozzle and said movable arc contact forming a first flow path for having an interior of said movable cylinder and an atmosphere in said container filled with said arc extinguishing gas communicate to each other through a first opening made in the flange of said movable cylinder;

a parting plate provided on a rear end portion of said movable cylinder, and forming a first space surrounded by the outer surface of said operating rod and an inner surface of said movable cylinder, a portion which defines an inner diameter of said parting plate being formed slidable on the outer surface of said stationary supporting tube, and a portion which defines an outer diameter of said parting plate being larger than an outer diameter of said movable cylinder;

a current collecting cylinder disposed to be coaxial with said operating rod, a part of said current collecting cylinder being formed slidable on a portion which defines an outer diameter of said parting plate of said movable cylinder, and having a current collecting plate at a front end portion thereof, which slides on the outer surface of said movable cylinder and being electrically contact therewith, and a supporting plate at a rear end portion thereof, which is fixed to said container and a portion thereof which defines an inner diameter being formed slidable on said operating rod, said current collecting cylinder forming a second space together with said parting plate, said stationary supporting tube and said supporting plate, having a plurality of grooves in an inner surface of a central portion thereof in an axial direction of said operating rod, engraved to be parallel to the axial direction, and a plurality of communication holes piercing from an inner surface to an outer surface at a portion of said current collecting cylinder situated between the plurality of grooves and said current collecting plate; and a check valve provided on said parting plate, for making the first space and the second space communicate to each other.

12. A gas circuit breaker according to claim 11, wherein during a current interruption operation in which said operating rod is drawn backwards from a state of said movable arc contact being engaged with said stationary arc contact, and said movable arc contact separates from said stationary arc contact, the gas in the second space is compressed by said parting plate, and a high-temperature gas made by an arc generated by said current interruption operation flows into said first space via the first flow path, thereby heating said first space to cause a pressure elevation.

13. A gas circuit breaker according to claim 11, wherein during a current interruption operation, when the portion which defines the outer diameter of said parting plate of said movable cylinder moves to a portion facing the plurality of grooves of said current collecting cylinder, the gas compressed in the second space flows out to the atmosphere of said container filled with the arc-extinguishing gas via the plurality of grooves and the plurality of communicating holes, thereby decreasing a pressure in the second space.

14. A gas circuit breaker according to claim 11, wherein during a current interruption operation, when the portion which defines the outer diameter of said parting plate of said movable cylinder moves beyond and passes a portion facing the plurality of grooves of said current collecting cylinder, the gas in the first space which has an elevated pressure flows out to the atmosphere of said container filled with the arc-extinguishing gas via the first flow path, thereby extinguishing an arc.

15. A gas circuit breaker according to claim 11, wherein during a current interruption operation, when the portion which defines the outer diameter of said parting plate of said movable cylinder passes a portion facing the plurality of grooves of said current collecting cylinder, and further moves close to said supporting plate, said check valve provided on said parting plate is opened, and thus the gas in the second space in which a pressure is elevated flows out to the first space.

16. A gas circuit breaker according to claim 11, wherein said parting plates and said movable cylinder are formed integrally.

17. A gas circuit breaker according to claim 11, wherein said parting plates are formed as a separate member from said movable cylinder.

18. A gas circuit breaker according to claim 11, wherein said current collecting cylinder comprises an outer cylinder and an inner cylinder, and the plurality of grooves are formed as opening portions which piercing through the inner cylinder.

* * * * *